US006895902B2

(12) United States Patent
Kobayashi et al.

(10) Patent No.: US 6,895,902 B2
(45) Date of Patent: May 24, 2005

(54) WATER HEATER WITH A FLAME ARRESTER

(75) Inventors: Toshihiro Kobayashi, Nagoya (JP); Hideo Chikazawa, Nagoya (JP); Masaru Kodama, Nagoya (JP)

(73) Assignee: Paloma Industries, Limited, Aichi-ken (JP)

( * ) Notice: Subject to any disclaimer, the term of this patent is extended or adjusted under 35 U.S.C. 154(b) by 41 days.

(21) Appl. No.: 10/396,746

(22) Filed: Mar. 25, 2003

(65) Prior Publication Data

US 2003/0183177 A1 Oct. 2, 2003

Related U.S. Application Data

(62) Division of application No. 09/834,535, filed on Apr. 13, 2001, now Pat. No. 6,561,138.

(30) Foreign Application Priority Data

Apr. 17, 2000 (JP) ..... 2000-11524
May 18, 2000 (JP) ..... 2000-146525
May 18, 2000 (JP) ..... 2000-146652

(51) Int. Cl.[7] ..... F24H 1/00
(52) U.S. Cl. ..... 122/13.01; 122/19.2; 122/504
(58) Field of Search ..... 122/13.01, 17.1, 122/17.2, 19.2, 504; 431/346

(56) References Cited

U.S. PATENT DOCUMENTS 6,082,310 A * 7/2000 Valcic et al. ..... 122/13.01
6,109,216 A * 8/2000 Reynolds et al. ..... 122/13.01
6,295,951 B1 * 10/2001 Valcic et al. ..... 122/13.01
6,435,140 B1 * 8/2002 Joyce ..... 122/13.01

* cited by examiner

*Primary Examiner*—Jiping Lu
(74) *Attorney, Agent, or Firm*—Pearson & Pearson, LLP

(57) ABSTRACT

A water heater is arranged with the hot water storage chamber R1 at the top and the combustion chamber R2 at the bottom within the body 11 which is a container. The combustion chamber R2 is equipped with the air supply inlet 13*a*, and the flame arrester 27 is provided at the air supply inlet 13*a*. Within the combustion chamber R2, the main burner 22 and the pilot burner 25 are provided, the changing state of flame of the pilot burner 25 is detected by the thermocouple 26, and a controller 41 closes an electromagnetic valve for opening and closing the main gas passage, stops the combustion of the main burner 22 as well, and rings the alarm 44. In a alternate embodiment, a sensor burner 60 is used as a safety device to detect a state of flame of the sensor burner and to shut off fuel to the main gas burner.

6 Claims, 15 Drawing Sheets

WATER HEATER WITH A FLAME ARRESTER

This application is a Division of U.S. application Ser. No. 09/834,535, filed Apr. 13, 2001 now U.S. Pat. No. 6,561, 138.

BACKGROUND OF THE INVENTION

1. Field of the Invention

The present invention relates to a water heater with a flame arrester set in a garage, a cellar, a warehouse and the like where inflammable materials such as gasoline, thinner, benzine and the like generating combustible vapor are stored.

2. Description of the Related Art

Conventionally, in this kind of a water heater with a flame arrester, for example, as shown in FIG. 19, a hot water storage chamber 2 and a combustion chamber 3 are provided upward and downward within a hollow cylindrical body 1, the combustion chamber 3 is provided with an exhaust passage 5 which penetrates the shaft center position and has an air supply inlet 4 and an opening on the upper portion of the body 1 for exhausting combustion gas within the combustion chamber 3, and further, a flame arrester (flame interruption apparatus) 6 is provided on the air supply inlet 4. A water heater with a flame arrester is made so that when exhaust gas at a high temperature burned with a gas burner 3*a* provided within the combustion chamber 3 passes through the exhaust passage 5, water supplied within the hot water storage chamber 2 is heated by the exhaust gas and stored as hot water at the predetermined temperature and then supplied to the outside of the water heater as appropriate. The flame arrester 6 is made of metal in a plate shape which is provided with a large number of minute openings such as a punching metal or an expand metal. Each inflammable gas has a quenching distance which is the largest gap that flame can not go through without being extinguished, since the flame arrester 6 utilizes this principle, the opening is made in a minute shape and the size of it is made in the range on the order of $\phi$1.5–3 mm.

SUMMARY OF THE INVENTION

However, since the opening of the flame arrester 6 is small as described above, it becomes easily clogged by combustion products such as dust, a drain generated by the combustion of the gas or the like. Therefore, if the flame arrester 6 had been clogged by dust or combustion products, an incomplete combustion state would be occurred due to the shortage of air supply within the combustion chamber 3, the state where carbon monoxide gas increases could be generated within the room around the water heater, and people within the room might have been suffered from carbon monoxide poisoning or the like.

Moreover, for the purpose of preventing sufferings from such carbon monoxide poisoning or the like, it is necessary to frequently do the work for cleaning the clogging of the flame arrester, and it has been very much troublesome.

Hence, an object of the invention is to solve the problem described above and to provide a water heater with a flame arrester capable of preventing trouble occurring with the shortage of the air supply due to the clogging of the flame arrester.

Moreover, another object of the invention is to provide a water heater with the shortage of the air supply due the clogging of the flame arrester as well as capable of saving the works of cleaning of the flame arrester for forcing the clogging itself of a flame arrester due to dust, the combustion products and the like not to be easily generated.

These and other objects are accomplished by a safety apparatus capable of maintaining safety in a room near by the foregoing body, when the air supply shortage or oxygen deficiency occurs within the foregoing combustion chamber due to the clogging of the foregoing flame arrester. It is preferable to employ the foregoing burner flame hanging detection means, and at least one of the foregoing fuel shut off means and an abnormality warning means.

Further, it is preferable to employ the foregoing clogging detection means, and at least one of the foregoing fuel shut off means and the abnormality warning means.

The object are further accomplished by providing a dust collection filter on the upstream side of the foregoing flame arrester.

The dust collection filter is approximately horizontally beneath the foregoing burner and the foregoing flame arrester is arranged approximately horizontally. The flame arrester and the dust collection filter are arranged vertically on the side wall of the combustion chamber. It is preferable to make the flame arrester and the dust collection filter at attachable and detachable from each other and to configure integrally the flame arrester and the dust collection filter. Further, it is preferable to configure dust collection filters as two filters opposing each other and arrange openings of the dust collection filters so that the openings are not projectively overlapped each other and to enable at least the dust collection filter on the upstream side to be attachable and detachable.

It is also preferable to provide heating means for maintaining the foregoing dust collection filter at a high temperature.

The objects are further accomplished by the flame arrester arranged beneath the foregoing burner horizontally, and further providing falling prevention means for preventing combustion products from falling from the upper side to the flame arrester.

A receiving member in the shape of an annulus is provided for receiving combustion products beneath the exhausting inlet as the falling prevention means.

A receiving member is provided in a circular shape without a hole for receiving combustion products beneath the exhausting inlet as the falling prevention means.

A receiving member is provided to cover most of the upper side of the flame arrester as the falling prevention means.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention, wherein.

DESCRIPTION OF THE PREFERRED EMBODIMENTS

Figure 1:
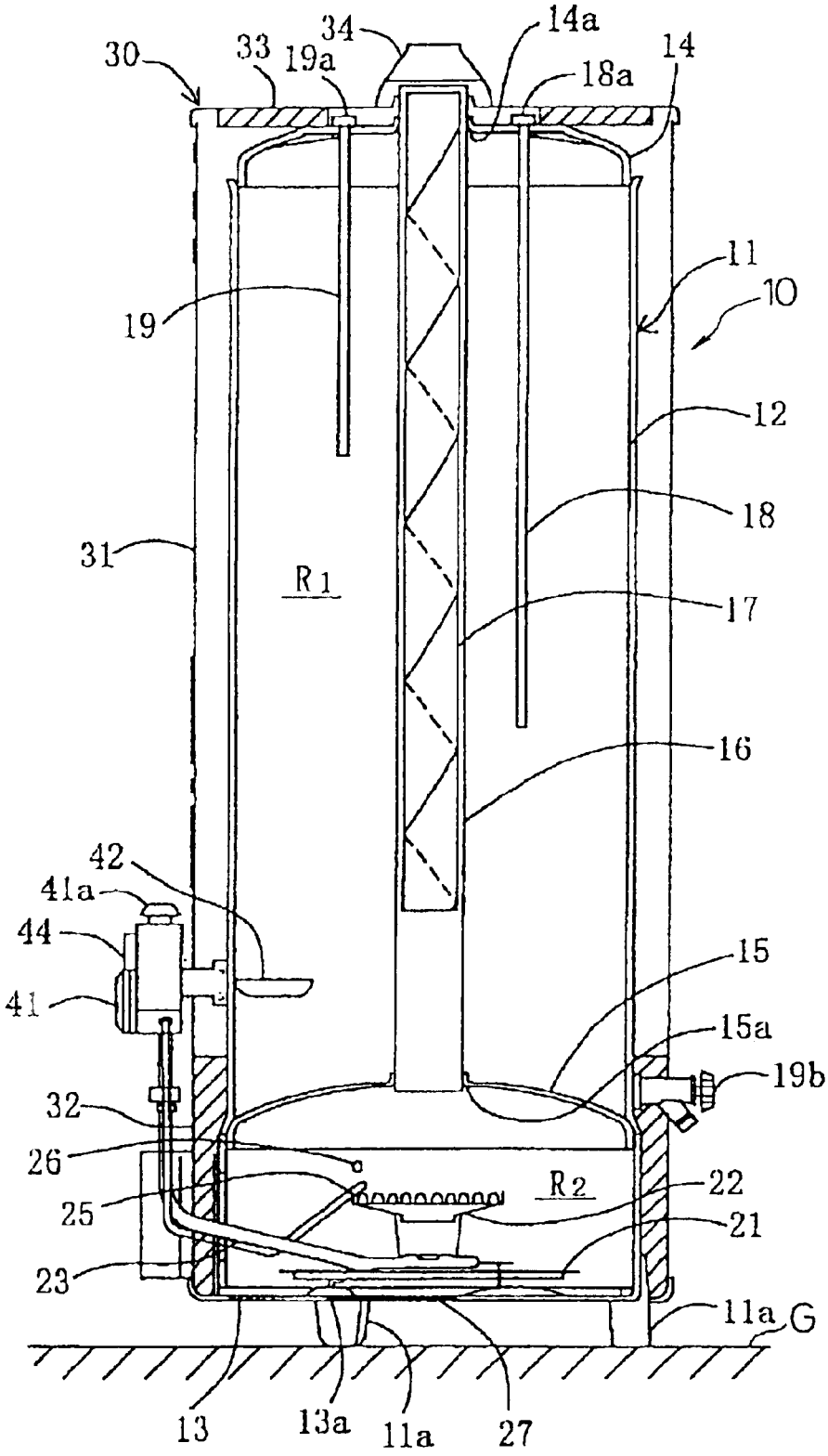
FIG. 1 is an elevational view in section conceptually showing a water heater with a flame arrester which is the first embodiment of the first invention.

Next, as one embodiment of the present invention will be described with reference to the drawings, FIG. 1 is an elevational view in section showing a water heater with a flame arrester (hereinafter, referred to as only water heater) of the first embodiment of the first invention. This water heater 10 is provided with a body 11 which is made of iron, closed on the ends of top and bottom portions of the hollow cylindrical shape and whose interior surface is covered with enamel, an outer case 30 which covers the outer peripheral and upper surface of the body 11, and a controller 41 for controlling an operation of the water heater 10.

The body 11 of the water heater 10 is provided with cylindrical portion 12, bottom plate portion 13 which is a flat plate for closing the end of the lower portion, an upper end plate 14 which is slightly swelled upward in a spherical shape and closes the end of the upper portion, and the body 11 is provided in a state where it stands on the floor surface G with legs 11*a* provided on the bottom plate portion 13. The body 11 is provided with a lower end plate 15 which is slightly swelled upward in a spherical shape and provided coaxially on the predetermined position nearer to the bottom plate portion 13, so that the body 11 is divided into the upper hot water storage chamber R1 and the lower combustion chamber R2.

The upper end plate 14 and the lower end plate 15 are provided respectively with openings 14*a* and 15*a*, an exhaust pipe 16 extending in an axial direction at the shaft center position and forming an exhaust passage penetrating the openings 14*a* and 15*a* is fixed on the openings 14*a* and 15*a*. Furthermore, within the exhaust pipe 16, a baffle plate 17 in a twisted plate shape is fixed between an upper position slightly apart from its lower end and the upper end position. The baffle plate 17 provides a spiral passage along the axial direction inside of the cylindrical body. Moreover, a water supply pipe 18 and a hot water supply pipe 19 which are vertically suspended downward are provided from the upper end plate 14 within the hot water storage chamber R1. Furthermore, on the upper end plate 14 within the hot water storage chamber R1 of the body 11, a water supply inlet 18*a* of the water supply pipe 18 through which water is supplied to the hot water storage chamber R1 and a hot water supply outlet 19*a* through which hot water within the hot water storage chamber R1 is supplied to the outside of the water heater 10 are provided, and a drain tap 19*b* is provided at the position located slightly upper portion from the lower end plate 15 for discharging the hot water within the hot water storage chamber R1 to the outside of the water heater 10.

Inside of the combustion chamber R2, a base plate 21 is provided slightly apart from the bottom plate portion 13, and a main burner 22 stands on the base plate 21. A gas supply pipe 23 penetrating the side wall of the body 11 is connected to the main burner 22. A pilot burner 25 is provided on the side of the main burner 22. Furthermore, a thermocouple 26 is provide on the side of the pilot burner 25 for detecting the changing state of the flame.

Then, an air supply inlet 13*a* is provided at the lower position of the above-described base plate 21 of the bottom plate portion 13, and a flame arrester 27 is fixed on the bottom plate portion 13 in order to cover the air supply inlet 13*a*. The flame arrester 27 is made of metal in a plate shape, which has a large number of minutes holes whose diameter is in the range of 1.5 mm–3 mm, for example, an expand metal, a punching metal, or a material in which these are laminated is employed. It should be noted that the flame arrester 27 may be equipped within an air supply pipe which is connected to the air supply inlet 13*a*.

The peripheral portion and the upper portion of the body 11 are covered with the outer case 30 through the mediation of a heat-retaining material. As for the cylindrical portion of the outer case 30, its upper portion between the upper end and the approximately uppermost position of the lower end plate 15 is made of the foregoing heat-retaining material 31 of polyurethane resin, and its lower portion is made of a glass fiber heat insulating material 32 whose material is prepared by mixing a fiber glass into a resin. On the upper surface of the outer case 30, a ring-shaped top plate 33 is embedded on the portion of the polyurethane resin and further, a hood 34 covering the end portion of the above-described exhaust pipe 16 projecting from the top surface is mounted.

The controller 41 is provided at the peripheral lower end position of the heat insulating material 31 of the outer case 30. A thermostat 42 is provided on the side of the controller 41 and arranged to penetrate the heat-retaining material 31 and the cylindrical portion 12 and to project within the hot water storage chamber R1. Moreover, an electromagnetic valve for opening and closing the passage to the above-described pilot burner 25 and the main burner 22 is built in the controller 41, and the thermocouple 26 is also connected to the controller 41. Furthermore, an alarm 44 is connected to the controller 41. A thermostat valve is also built in the controller 41 for closing the main gas passage to stop the gas supply to the main burner 22 when the detected temperature of the thermostat 42 becomes the predetermined value T1 or higher, and for opening the main gas passage to initiate the gas supply to the main burner 22 and to start the combustion when the detected temperature becomes the predetermined value T2 (<T1) or lower, the thermostat valve is opened.

Moreover, when an output of the thermocouple 26 is lowered less than the predetermined value due to the shortage of the air supply the controller 41 also closes the gas passage to the gas supply pipe 23 and stops the gas supply to the main burner 22 in a similar manner and is capable of preventing an accident such as carbon monoxide poisoning due to the leakage of carbon monoxide to the outside of the body 11 because of an incomplete combustion of the main burner 22. Similarly, the controller 41 is capable of preventing the accident due to the incomplete combustion of the main burner 22 by sounding the alarm 44.

Next, operations of the above-described embodiment will be described below.

Figure 2:
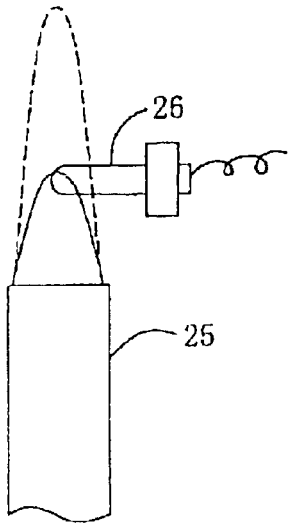
FIG. 2 is an illustration for illustrating a state of combustion of flame in a pilot burner of the water heater with a flame arrester which is the first embodiment of the first invention.
Figure 3:
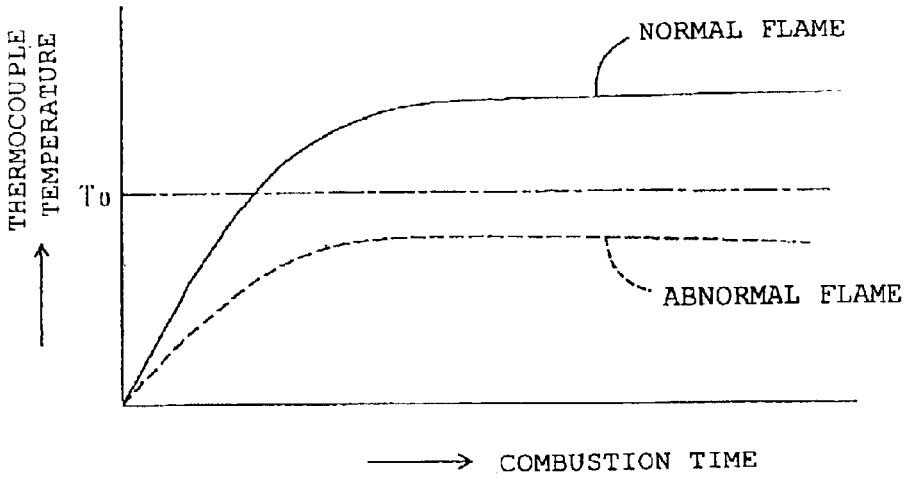
FIG. 3 is a graphical representation for illustrating a state of combustion of flame in the foregoing pilot burner of the water heater with a flame arrester which is the first embodiment of the first invention.

First, the pilot burner 25 is ignited while pressing down an ignition knob 41*a* positioned on the upper portion of the controller 41. Electromotive force is generated in the thermocouple 26 which is heated by the pilot burner 25, and the built-in electromagnetic valve is maintained to be open and attracted (the knob is released from the hand at this moment) Moreover, the ignition knob 41*a* is turned around to the left and when the main gas passage is opened, the main burner 22 is ignited. Thus initiating the operation of the water heater lets the thermocouple 26 detect the changes of the flame of the pilot burner 25. When the flame arrester 27 is not clogged and the air is sufficiently supplied to the inside of the combustion chamber R2, as shown in FIG. 2, flame of the pilot burner 25 is represented by the solid line, and the detected result by the thermocouple 26 also exceeds the reference value T0 as shown in FIG. 3. At this moment, since the hot water temperature within the hot water storage chamber R1 is still low, the thermostat valve built in the controller 41 is still opened, and the combustion by the main burner 22 is initiated. The hot water within the hot water storage chamber R1 is heated and its temperature rises by the procedure that the high temperature exhaust gas generated by the combustion rises through the exhaust pipe 16 while the exhaust gas is heating the lower end plate 15 and the exhaust gas passes by the baffle plate 17. Then, when the thermostat 42 detects that the temperature of the hot water becomes T1 or higher, the above-described thermostat valve is closed and the flame of the main burner 22 is extinguished. When the temperature of the hot water drops or when the hot water is discharged through the hot water supply pipe 19 and the hot water storage chamber R1 is filled up with water supplied from the water supply pipe 18 and the temperature of the hot water becomes T2 or lower, the lowered temperature is detected by the thermostat 42, the main gas passage is opened by opening the thermostat valve, the combustion by the main burner 22 is initiated again, and the hot water within the hot water storage chamber R1 is heated.

During the time in which the above-described heating within the hot water storage chamber R1 by the main burner 22 is repeated, if the flame arrester 27 is clogged up with dust or the like, the air supply shortage or oxygen deficiency occurs within the combustion chamber R2, therewith resulting in the extension of flame of the pilot burner 25 represented by the dashed line as shown in FIG. 2, and the detected result by the thermocouple 26 becomes the reference value T0 or lower as shown in FIG. 3. The controller 41 receiving this detected result of the thermocouple 26 closes the built-in electromagnetic valve, and shuts off the gas supply to the main burner 22. At the same time, the alarm 44 goes off, an accident due to an incomplete combustion of the main burner 22 can be prevented.

As a result, the combustion in the main burner 22 in a state of the air shortage is stopped, excessive generation of carbon monoxide by the incomplete combustion can be prevented, and poisoning by carbon monoxide within the room due to the leakage of carbon monoxide to the outside of the body 11 can be prevented. When obtaining this result, the normal combustion operation of the main burner 22 can be recovered by means of the procedure that the flame arrester 27 is removed from the body 11, the clogging is removed and the flame arrester 27 is reset in the body 11, and the hot water within the hot water storage chamber R1 can be heated.

Figure 4:
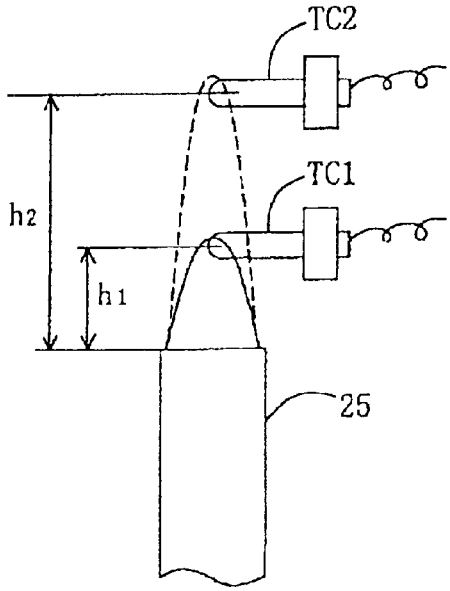
FIG. 4 is an illustration for illustrating a state of combustion of flame in a pilot burner of the water heater with a flame arrester, which is an example of modification of the first embodiment of the first invention.
Figure 5:
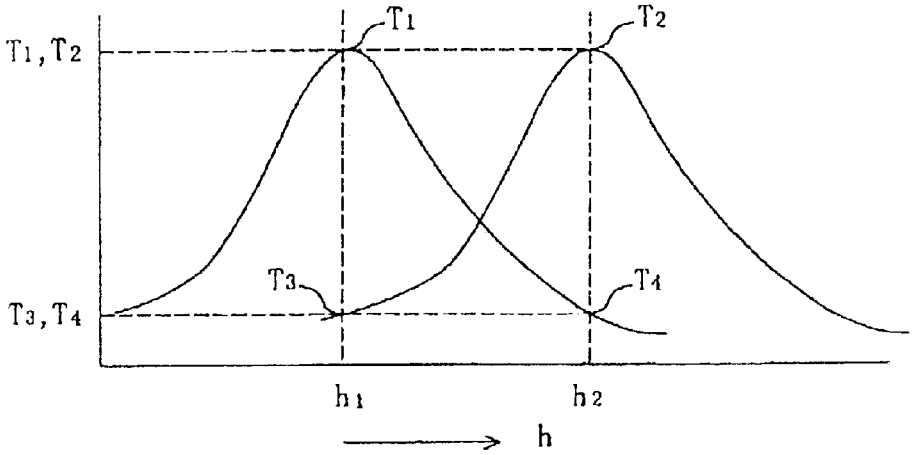
FIG. 5 is a graphical representation for illustrating a state of combustion of flame in the pilot burner depicted in FIG. 4 of the water heater with a flame arrester, which is an example of modification of the first embodiment of the first invention.

Next, in the above-described embodiment, one modified example of the detection of flame temperature by the thermocouple will be described below with reference to FIG. 4 and FIG. 5. In the modified example, the flame temperature of the pilot burner 25 is detected by the two pieces of thermocouples, TC1 and TC2. As shown in FIG. 4, the first thermocouple TC1 is disposed at the position h1 of the flame at the time of complete combustion, the second thermocouple TC2 is disposed at the position h2 of the flame at the time of incomplete combustion, and further, both of the thermocouples is connected in series by inversing the polarity of one thermocouple. Thus, the detected value of both thermocouples ΔT is represented by the following expression according to FIG. 5.

$$\Delta T = (T1 - T3) - (T4 - T2) \qquad \text{[Expression 1]}$$
$$= (T1 - T3) + (T2 - T4)$$

Specifically, since the detected value is (T1−T3) in the case where one piece of thermocouple is placed at the position h1, by providing and arranging two pieces of thermocouples, the sensitivity of the detected value is enhanced by the value (T2−T4), and the state of the temperature of the flame can be acknowledged more precisely.

Next, the second embodiment of the present invention will be described below with reference to FIG. 6 and FIG. 7.

In the second embodiment of the first invention, it is made so that the clogging state of the flame arrester 27 can be detected by the shape of the pilot burner and the electromagnetic valve built in the controller 41 can be closed according to the state of clogging. Specifically, the pilot burner is used as detection means for detecting the clogging of the flame arrester 27. The pilot burner 50 is, as shown in FIG. 6, a hollow cylindrical body 51, whose end is a cone-shaped projecting portion 52 projecting in an axial direction. A port for heating thermocouple 53 is provided on the side wall nearby the projecting portion 52 of the cylindrical body 51, a port for carrying over 54 is provided on the projecting portion 52. Moreover, the cylindrical body 51 is provided with air supply holes 55 nearby the connection portion with the gas supply pipe 58, over which wire gauze 56 covers and surrounds air supply holes 55. The meshes of the wire gauze 56 is finer than those of the flame arrester 27. On the side of the port for heating thermocouple 53 of the pilot burner 50, a thermocouple 57 is provided and arranged.

Figure 6:
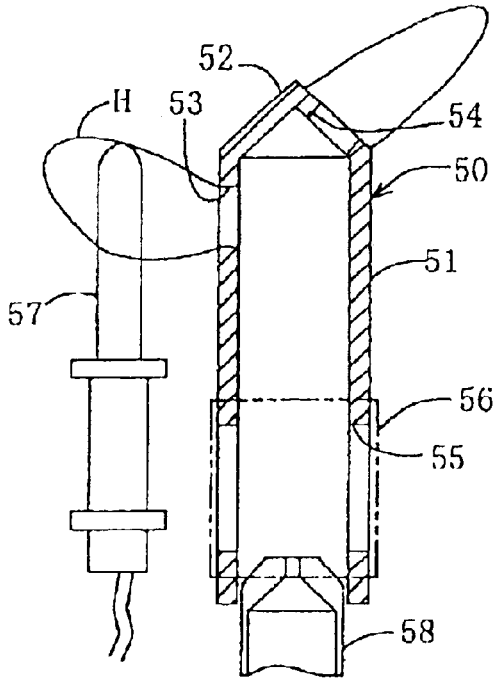
FIG. 6 is an illustration for illustrating a state of complete combustion of flame in a pilot burner of the water heater with a flame arrester, which is the second embodiment of the first invention.
Figure 7:
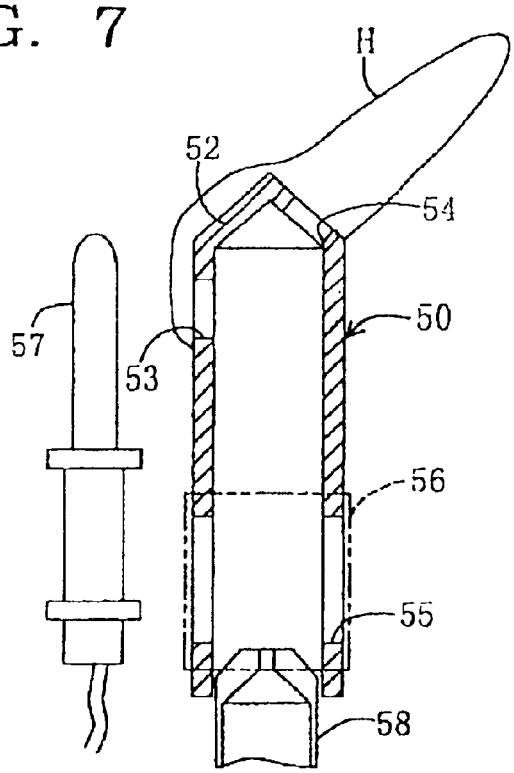
FIG. 7 is an illustration for illustrating a state of incomplete combustion of flame in the pilot burner depicted in FIG. 6 of the water heater with a flame arrester, which is the second embodiment of the first invention.

In the second embodiment of the first invention, when the clogging of the flame arrester 27 does not exist, the air is sufficiently supplied to the combustion chamber R2, and the pilot burner 50 completely burns due to air from the air supply hole 55, as shown in FIG. 6, flame H is formed at the port for heating thermocouple 53 and the port for carrying over 54, and the flame temperature is normally detected by the thermocouple 57. On the other hand, as the clogging of the flame arrester 27 proceeds, the wire gauze 56 which is clogged more easily than the flame arrester 27 is more significantly clogged. Therefore, when the air supply from the air supply hole 55 becomes insufficient and the air supply to the pilot burner 50 becomes short, as shown in FIG. 7, the flame H is formed at the port for carrying out 54 but the flame H is not formed normally at the port for heating thermocouple 53. As a result, the flame can not be detected by the thermocouple 57, the clogging of the flame arrester 27 can be detected. Upon receiving this detected result of the thermocouple 57, the controller 41 closes the built-in electromagnetic valve and shuts off the gas to the main burner 22. As a result, the gas combustion in a state of shortage of air supply is stopped, the generation of carbon monoxide due to the incomplete combustion can be prevented, and the occurrence of the poisoning due to carbon monoxide within the room by the leakage of carbon monoxide to the outside of the body 11 can be prevented.

Figure 8:
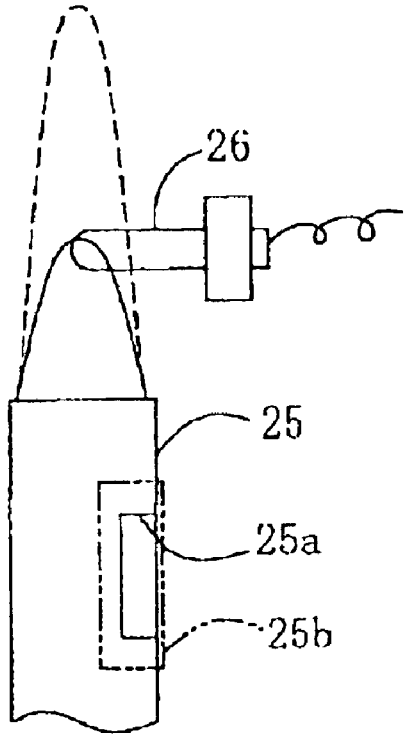
FIG. 8 is an illustration for illustrating a state of combustion of flame in a pilot burner of the water heater with a flame arrester, which is an example of modification of the second embodiment of the first invention.

It should be noted that as an example of the above-described second embodiment of the first invention, as shown in FIG. 8, the opening 25*a* may be provided on the side wall of the pilot burner 25 shown in the first embodiment and covered with the wire gauze 25*b* whose meshes is finer than the flame arrester 27 in the same way as the above-descried wire gauze 56. According to this modified example, the progress of the clogging of the flame arrester 27 can be previously detected with the wire gauze 56 which is clogged more easily than the flame arrester 27. Specifically, the thermocouple 26 can detect the change from the flame in the solid line to the flame in the dashed line due to the shortage of the air supply from the opening 25*a* because of the clogging of the wire gauze 25*b*.

Figure 9:
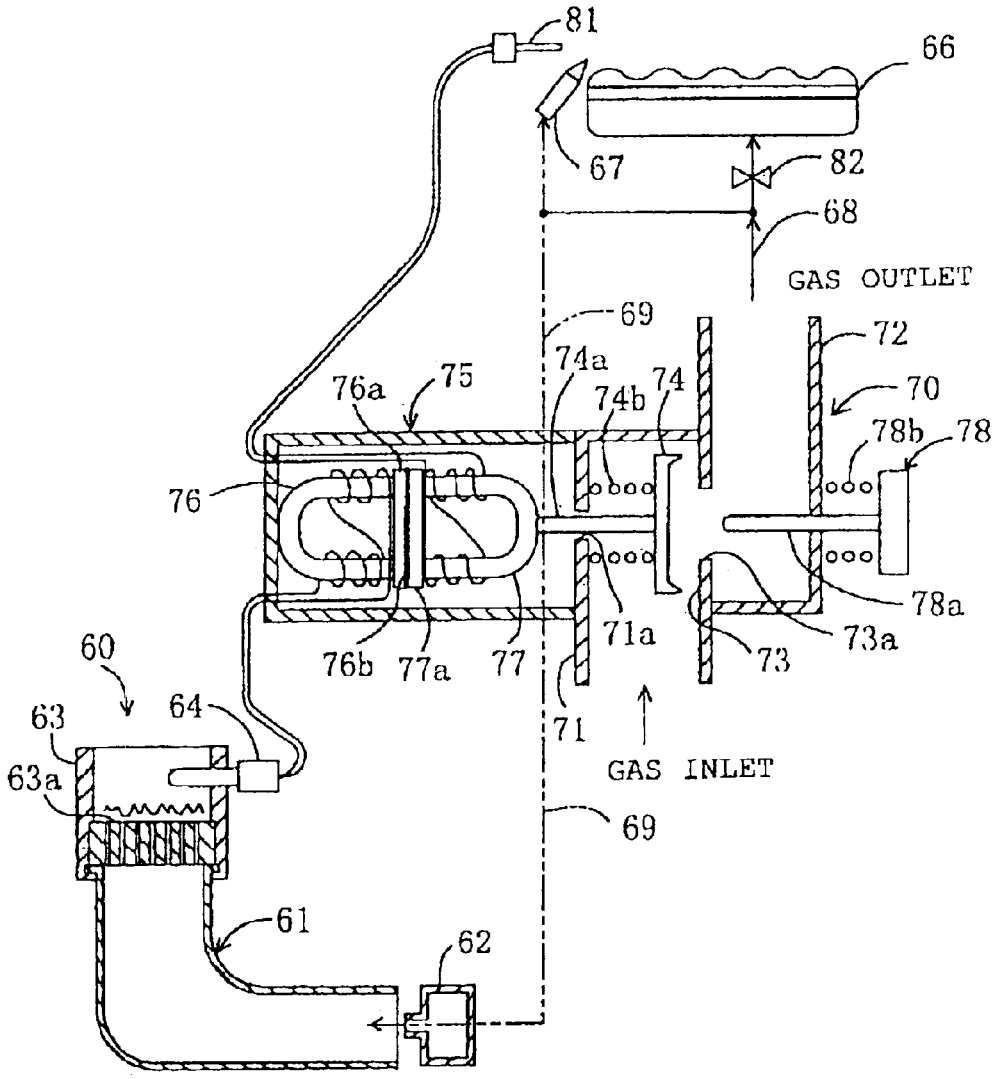
FIG. 9 is a block diagram schematically showing an example of detecting a state of gas combustion where a sensor burner and a pilot burner are combined, the burners being the third embodiment of the first invention.

Next, the third embodiment of the first invention will be described below with reference to FIG. 9.

In the third embodiment, as detection means for detecting a state of flame, the sensor burner 60 which is capable of securely detecting a state of flame is used with the pilot burner. The sensor burner 60 is mounted on a gas draft pipe 69 branched off from the gas supply pipe 68 described later, and comprises the mixture pipe 61 approximately L-letter shaped, a porous plate 63*a* having ports, a cylindrical guard 63 surrounding the porous plate 63*a*, and a thermocouple 64. The mixture pipe 61 is provided with a nozzle 62 connected to the gas draft pipe at the end, and the porous plate 63*a* having ports provided inwardly in the axial direction and the cylindrical guard 63 surrounding the porous plate 63*a* are provided at the other end of the mixture pipe 61. The thermocouple 64 is provided nearby the outside of the porous plate 63*a* and arranged to penetrate the wall of the cylindrical guard 63. Moreover, the sensor burner 60 is connected to the gas supply pipe 68 supplying the gas to the main burner 66 and the pilot burner 67, and is provided with a gas shut off valve 70 for opening and closing the gas supply pipe 68.

The gas shut off valve 70, the first pipe portion 71 on the straight upstream side, and the second pipe portion 72 on the straight downstream side paralleling to the first pipe portion 71 form an approximately S-letter shaped pipe passage. The portion between the first pipe portion 71 and the second pipe portion 72 is divided in the axial direction of the gas shut off valve 70 by a valve seat 73 having an opening 73*a* in the center. A penetrated portion 71*a* is opposed to the valve seat 73 of the first pipe portion 71, an opening and closing valve 74 in a plate shape is pressed on the valve seat 73 by a coil spring 74*b* which surrounds the penetrated portion 71*a*, and closes the opening 73*a*, thereby closing the pipe passage. Moreover, an axis 74*a* on which the opening and closing valve 74 is mounted is securely fixed on a movable electromagnet 77 on the left side through the penetrated portion 71*a*.

On the left side of the penetrated portion 71*a* of the first pipe portion 71, a magnet 75 which is a cylindrical case is mounted. On an opposing face to the penetrated portion 71*a* within the magnet 75, a U-letter shaped, fixed electromagnet 76 provided with an attracting plate 76*a* on the head is fixed so that the head portion of the fixed electromagnet 76 faces the penetrated portion 71*a*. Moreover, a non-magnetic plate 76*b* is sandwiched between the attracting plate 76*a* and an attracting plate 77*a*.

The fixed electromagnet 76 is connected to the thermocouple 64 of the sensor burner 60, and generates the predetermined magnetic force when the normal ignition of the sensor burner 60 is detected. On the other hand, the movable electromagnet 77 is connected to the thermocouple 81 provided on the side of the pilot burner 67, and generates the predetermined magnetic force when the normal ignition of the pilot burner 67 is detected. Therefore, in the case where the combustion of at least one of the sensor burner 60 or the pilot burner 67 becomes incomplete due to the clogging of the flame arrester, the electromotive force of either the thermocouple 64 or 81 is lowered, the magnetic force of the electromagnets 76 and 77 is lowered, and the electromagnet 77 becomes apart from the electromagnet 76. Needless to say, it is also operated at the time of extinguishing the pilot burner 67.

An ignition button 78 which is pressed at the time of the initiation of the operation of the water heater is opposed to the valve seat 73 of the second pipe portion 72. The ignition button 78 is provided with a push rod 78*a* which has penetrated the pipe wall of the second pipe portion 72, whereas, it is constantly pressed outside of the second pipe portion 72 in the outer direction by a coil spring 78*b*. Therefore, the end of the push rod 78*a* is usually positioned across the valve seat 73 from the opening and closing valve 74. It should be noted that a thermostat valve 82 is equipped on the above-described gas supply pipe 68 on the side of the main burner 66, thus opens and closes the main gas passage according to the detected temperature of the above-described thermostat 42.

In the above-mentioned third embodiment of the first invention, pressing down the ignition button 78 for the initiation of an operation of the water heater causes the push rod 78*a* to press the opening and closing valve 74 which has closed the opening 73 pressed on the valve seat 73 by the coil spring 74*b*. At this moment, the sensor burner 60 and the pilot burner 67 are normally ignited, and accompanying with that, the electromagnets 76 and 77 generate the predetermined magnetic force, therefore, the electromagnet 77 pushed by the push rod 78*a* attracts on the electromagnet 76. Therefore, the opening and closing valve 74 opens the valve seat 73, the gas shut off valve 70 is open, the gas is supplied to the main burner 66, and its combustion is initiated. It should be noted that it will be available if the corresponding ones of the first embodiment are applied to the ignition button 78 and the thermostat valve 82 in the third embodiment.

On the other hand, when the combustion of one of the sensor burner 60 or the pilot burner 67 becomes incomplete due to the clogging of the flame arrester, the electromotive force of at least either the thermocouples 64 or 81 is lowered, the magnetic force of the electromagnet 76 or 77 is lowered, and the electromagnet 77 becomes apart from the electromagnet 76. As a result, the opening and closing valve 74 is pressed by the coil spring 74*b* and closes the opening 73*a* of the valve seat 73. Thus, the gas shut off valve 70 is closed, the gas supply to the main burner 66 is shut off, and its combustion is stopped.

As a result, also in the third embodiment, the combustion at the main burner 66 running short of the air supply is stopped, the excessive generation of carbon monoxide due to the incomplete combustion can be prevented, and the occurrence of the poisoning due to carbon monoxide in the room by the leakage of carbon monoxide to the outside of the body 11 can be prevented.

Figure 10:
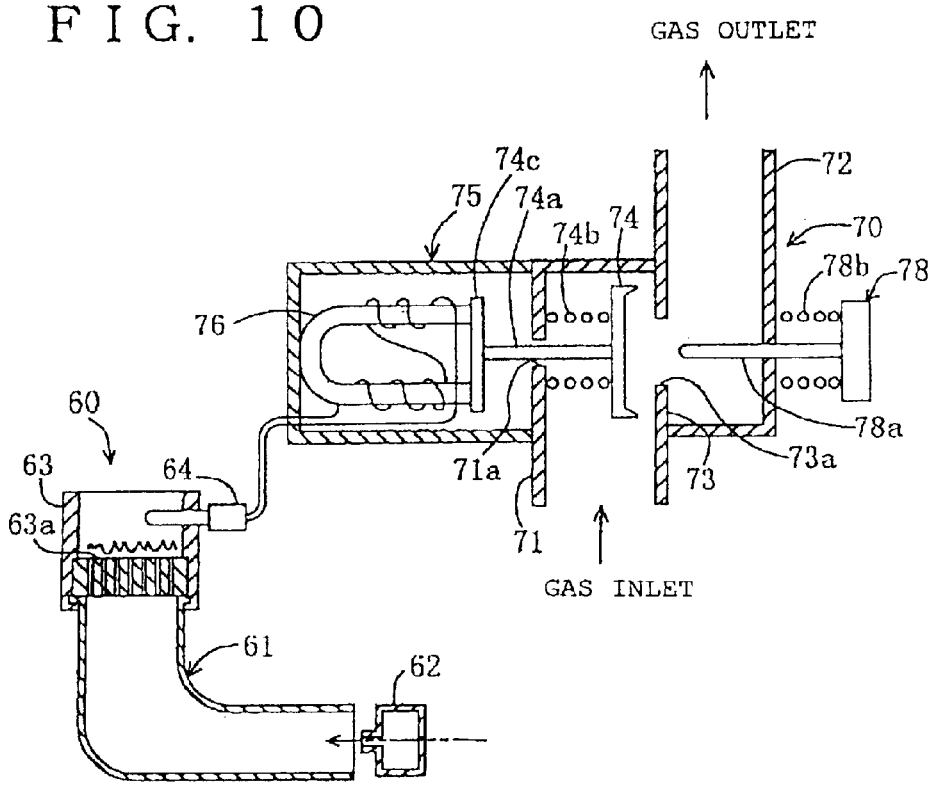
FIG. 10 is a block diagram showing a state of gas combustion using a sensor burner, which is an example of modification of the third embodiment of the first invention.

It should be noted that as the modified example of the third embodiment, as shown in FIG. 10, it will be available that only the sensor burner 60 is employed as detection means for detecting a state of flame without employing the pilot burner. Specifically, in the magnet 75 of the gas shut off valve 70, an attracting plate 74*c* is mounted on the end of the axis 74*a* provided at the center of the opening and closing valve 74 and projecting toward the magnet 75, and the U-letter shaped fixed electromagnet 76 whose head portion faces the penetrated portion 71*a* is fixed on the opposed face to the penetrated portion 71*a* within the magnet 75. Since the other configuration of the gas shut off valve 70 is similar to those shown in the above-described third embodiment, the description is omitted.

In the modified example, the attracting plate 74*c* pushed by the push rod 78*a* attracts the fixed electromagnet 76 by pressing the ignition button 78 at the time of the initiation of the operation of the water heater. Therefore, the opening and closing valve 74 opens the valve seat 73, the gas shut off valve 70 is open, the main burner 66 is supplied with the gas, and its combustion is initiated. On the other hand, the combustion of the sensor burner 60 becomes incomplete due to the clogging of the flame arrester, the electromotive force of the thermocouple 64 is lowered. Thus, the magnetic force of the fixed electromagnet 76 is lowered and the attracting plate 74*c* is apart from the fixed electromagnet 76, the opening and closing valve 74 is pressed by the coil spring 74*b* and closes the opening 73*a* of the valve seat 73. Thus, the gas shut off valve 70 is closed, the gas supply to the main burner 66 is shut off, and its combustion is stopped. As a result, also in the modified example, the effect similar to that of the third embodiment is obtained.

Figure 11:
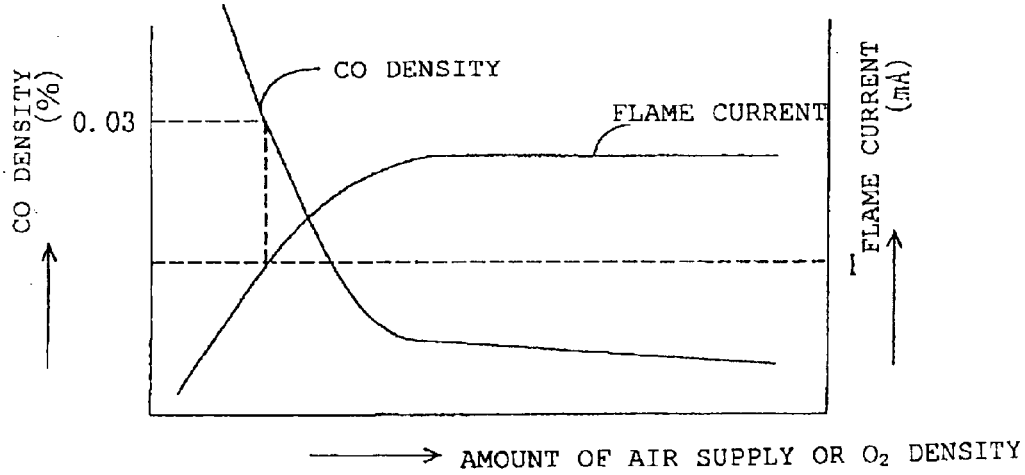
FIG. 11 is a graphical representation for illustrating a state of combustion of flame in the case of employing a flame rod.

It should be noted that in the above-described respective embodiment, although the thermocouple is employed in order to detect a state of combustion of the flame, instead of this, the flame current can be monitored by employing a flame rod. As for the flame rod, the flame current is lowered when the flame is in an incomplete combustion state, and the flame current is high when the flame is in a complete combustion state. The relationship of an amount of the air supply or oxygen density with CO density and the flame current is schematically shown in FIG. 11, however, for example, CO density can be prevented from rising more than 0.03% by shutting off the gas by means of closing the electromagnetic valve of the main gas passage sending 1 mA or less of the flame current. Thus, the combustion running short of the air is stopped, the excessive generation of carbon monoxide due to the incomplete combustion can be prevented, and the occurrence of the poisoning due to carbon monoxide in the room by the leakage of carbon monoxide to the outside of the body 11 and the like can be prevented.

It should be noted that in the above-described respective embodiments, although the alarm 44 goes off as well as the combustion at the main burner 22, 66 is stopped by closing the electromagnetic valve for opening and closing the passage to the main burner when the clogging of the flame arrester 27 is occurred, instead of this, only one of the functions may be activated.

Then, an embodiment of the second invention in which the flame arrester cannot be sassily clogged by the dust or the like will be described below with reference to FIG. 12. It should be noted that since the same reference numerals as ones described in the afore-mentioned first invention denote the same configuration portions, the overlapped description will be omitted.

Now, the body 11 is provided with a base portion 90 which is a flat plate dividing the inside of the body 11 upward and downward at the position slightly upper from the bottom plate portion 13, and a communication chamber S1 in which the air outside communicates beneath the base portion 90. In the cylindrical portion 12, an air hole 12*a* is partially provided beneath the base portion 90. Inside of the combustion chamber R2, the base plate 21 is provided slightly apart from the base portion 90, the main burner 22 is provided standing upright.

Then, an air supply inlet 90*a* is provided on the base portion 90 below the above-described base plate 21, the flame arrester 27 which covers this air supply inlet 90*a* is fixed on the base portion 90.

Moreover, a cover member 91 which is a hollow approximately cylindrical cover surrounding the air supply inlet 90*a*, and projecting from the lower surface of the base portion 90 is mounted on the lower surface of the base portion 90. An opening is provided on the horizontal flat plate portion of the cover member 91, and a circular dust collection filter 92 covering this opening is fixed on the cover member 91. The dust collection filter 92 is made of metal in a plate shape having a large number of minutes holes on the order of the diameter of 4 mm, for example, an expand metal, punching metal, or the ones in which these are laminated is employed. It should be noted that a mounted position of the dust collection filter 92 is not limited to this, the dust collection filter 92 is provided at the air supply pathway for supplying the air outside to the flame arrester 27.

On the other hand, as for the glass fiber heat insulating material 32, the lower side from the lower end plate 15 is removed in the predetermined range including the air hole 12*a* of the circular cylindrical portion 12*a*, and the portion between the portion of the glass fiber heat-retaining material 32 and the outer case 30 is a space portion S2. In the outer case 30, the air hole 93 through which the air outside faces and flows into this space portion S2 is provided. Hence, the air outside flown into the space portion S2 further flows into the communication chamber S1 via the air hole 12*a*, passes through the dust collection filter 92 and the flame arrester 27, and flows into the combustion chamber R2.

Hence, in the present water heater, the purified air which is removed the large dust from the air outside by the dust collection filter 92 provided upstream of the flame arrester 27 can be sent to the flame arrester 27. Specifically, since the larger dust in the air outside is first removed by the dust collection filter 92, the clogging of the flame arrester 27 is relatively delayed. Moreover, since the accumulated dust can be fallen down by the weight of the dust itself by providing the dust collection filter 92 beneath the main burner 22 in a horizontal direction, the clogging of the dust collection filter 92 can be further delayed. Therefore, the clogging of the flame arrester 27 can be largely delayed compared to the case of the prior art, the possibility of the carbon monoxide poisoning due to the clogging of the flame arrester 27 can be lowered as well as the chore of the cleaning can be relatively reduced.

Next, an modified example of the dust collection filter will be described below with reference to FIG. 13.

In this modified example, a flame arrester and a dust collection filter are arranged vertically on the side wall of the combustion chamber. Specifically, as shown in FIG. 13, the main burner 22 is placed on the bottom plate portion 13 of the body 11, an opening 94 is provided nearby the bottom portion 13 of the cylindrical portion 12, the flame arrester 95 covering the opening 94 is mounted on the cylindrical portion 12, and further, an opening 96 is provided on the outer case 30 surrounding the cylindrical portion 12, and located slightly upper from the above-described opening 94, and the dust collection filter 97 covering the opening 96 is mounted on the outer case 30. Thus, it is made so that the air outside passes through in turn the dust collection filter 97 and the flame arrester 95 and flows into the combustion chamber R2.

In the present modified example, by providing the flame arrester 95 and the dust collection filter 97 vertically on the side of the combustion chamber R2, even if the combustion products such as drain generated within the combustion chamber R2 and the like fall, it is made so that they are not easily adhered to the flame arrester 95. Moreover, the purified air which is removed the large dust from the air outside by the dust collection filter 97 provided upstream of the flame arrester 95 is sent to the flame arrester 95. Therefore, as to the flame arrester 95, the clogging factors from the inside and outside of the combustion chamber R2 is diminished, the clogging of the flame arrester 95 is largely delayed. Therefore, the chore of cleaning the flame arrester 95 is largely reduced.

Next, another modified example will be described below with reference to FIG. 14.

In the present modified example, it is made so that the dust collection filters are consisted of two sheets and the respective openings of the dust collection filters are not overlapped in an opposed direction. Specifically, as shown in FIG. 14, the main burner 22 is placed on the bottom plate portion 13 of the body 11, the opening 98 is provided nearby the bottom plate portion 13 of the cylindrical portion 12, and the flame arrester 99 covering the opening 98 is mounted on the cylindrical portion 12. Furthermore, the opening 100 is provided on the outer case 30 surrounding the cylindrical portion 12, and located slightly upper from the above-described opening 98, the first filter 101*a* covering the opening 100 is mounted on the outer case 30, and further outside of the first filter 101*a*, the second filter 101*b* which is another member is mounted on the outer case 30, thereby configuring the dust collection filter 101. The first filter 101*a* and the second filter 101*b* are opposed in parallel each other, and they are arranged so that small holes of the first filter 101*a* and the small holes of the second filter 101*b* are not projectively (in an opposed direction) overlapped each other. Thus, it is made so that the air outside passes through in turn the second filter 101*b* and the first filter 101*a* of the dust collection filter 101 and the flame arrester 99 and flows into the combustion chamber R2.

In the present modified example, since first, a large amount of dust is removed with the second filter 101*b* on the upstream side, the dust passed through the small hole hits the first filter 101*a* on the downstream side and is removed, the large dust can be efficiently removed through two filters 101*a* and 101*b*. Moreover, since the second filter 101*b* which is placed upstream and on which dust is easily clogged is attachable and detachable, the second filter 101*b* can be removed and easily cleaned. Moreover, since the purified air which is removed the larger dust in the air outside can be sent to the flame arrester 99 through the dust collection filter 101 provided on the upstream side of the flame arrester 99, the clogging of the flame arrester 99 can be delayed. Moreover, similar to the afore-mentioned modified example, if the combustion products such as drain generated within the combustion chamber R2 and the like fall, the combustion products and the like are not easily adhered to the flame arrester 99 by providing the flame arrester 99 and the dust collection filter 101 vertically on the side of the combustion chamber R2. Therefore, the chore of cleaning the flame arrester 99 is largely reduced.

Figure 12:
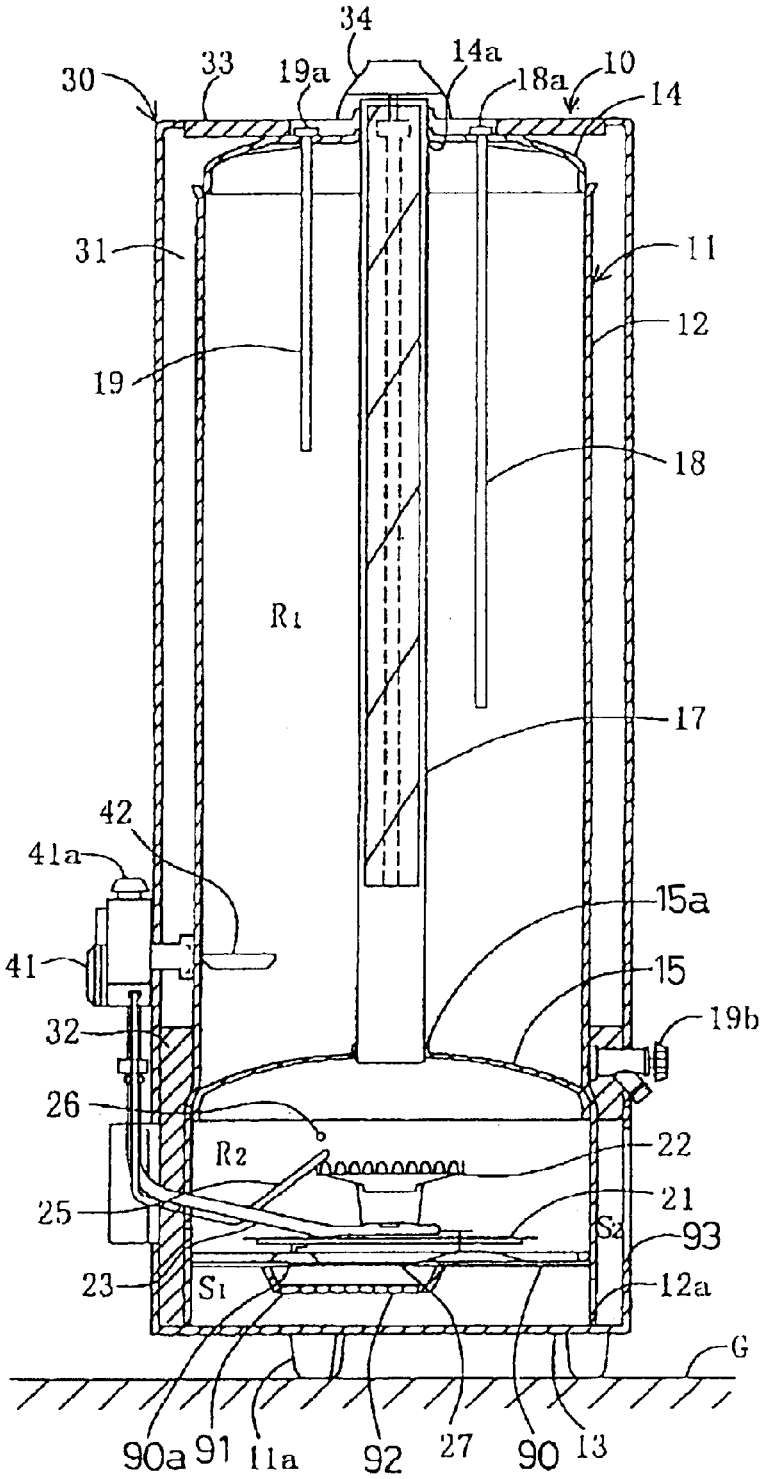
FIG. 12 is an elevational view in section schematically showing a water heater with a flame arrester which is the first embodiment of the second invention.

It should be noted that the modified example in which two dust collection filters are arranged in parallel each other, and further two filters are arranged so that the respective small holes of the filters are not overlapped in an opposed direction can be also applied to the case where the filter is arranged in a horizontal direction as the dust collection filter as shown in FIG. 12.

Figure 13:
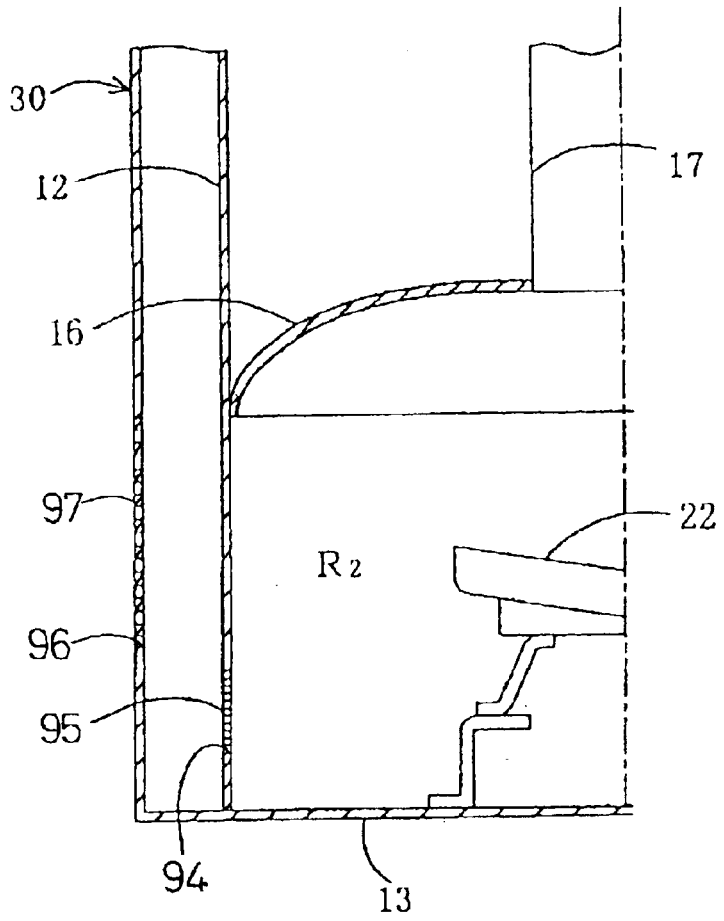
FIG. 13 is a sectional view showing the essential parts of a water heater with a flame arrester, which is the second embodiment of the second invention.
Figure 14:
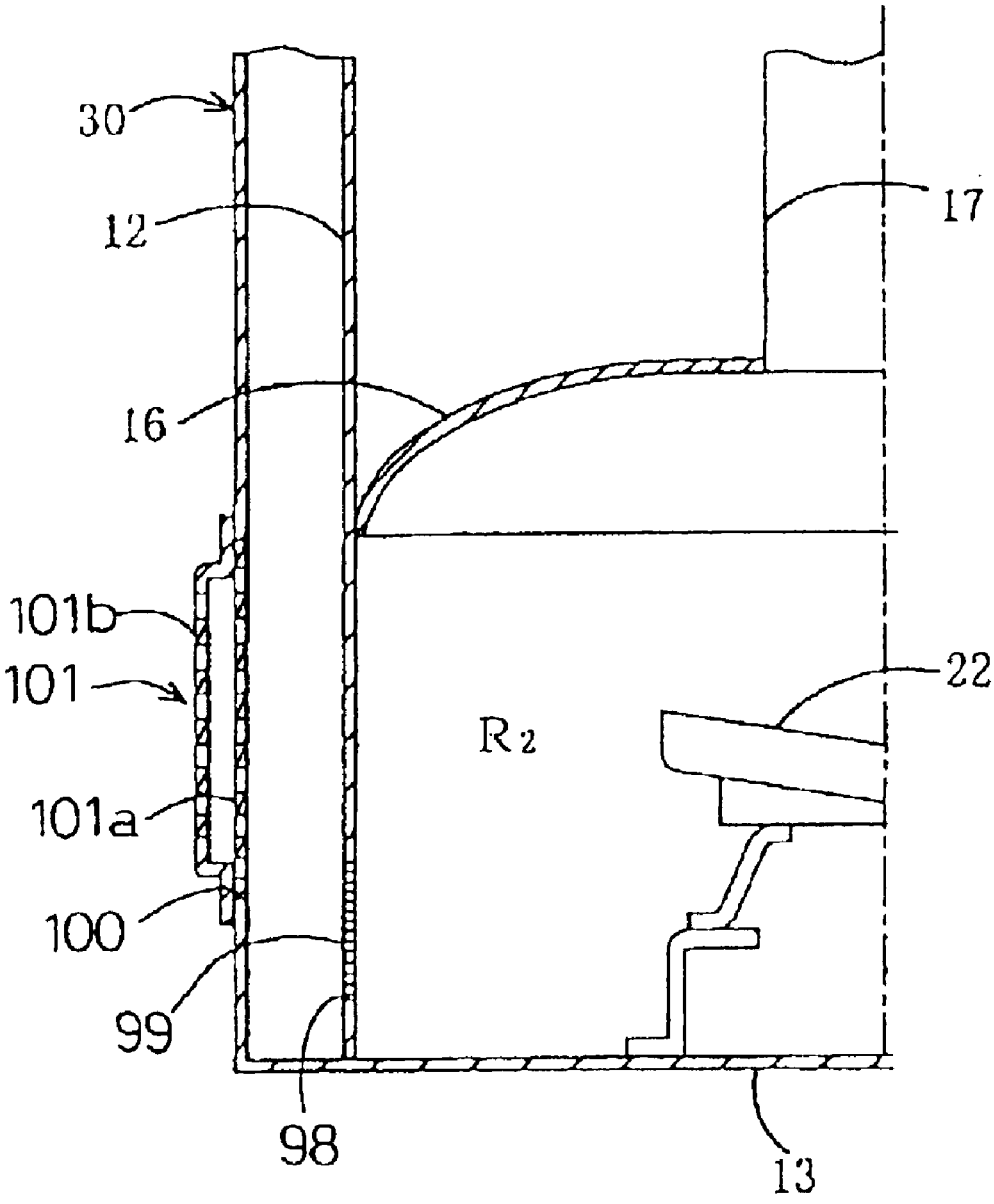
FIG. 14 is a sectional view showing the essential parts of a water heater with a flame arrester, which is the third embodiment of the secondt invention.

It should be noted that in the embodiments shown in the above-described FIG. 12 through FIG. 14, heating means for heating the dust collection filter and maintaining at the high temperature on the order of 200° C. or higher can be provided. Thus, the dust adhered to the dust collection filter is easily decomposed and removed by heating, an auto cleaning effect with which the dust is removed through the dust collection filters is obtained, and the dust collection filters can be made not to be easily clogged. As a result, the clogging of the flame arrester can be further delayed as well as the chore of cleaning the dust collection filters can be reduced, and the chore of cleaning the flame arrester can be largely reduced.

Moreover, in the embodiments shown in the above-described FIG. 12 through FIG. 14, the dust collection filter and the flame arrester are provided as separate bodies, respectively, however, the dust collection filter and the flame arrester are made so as to be attachable and detachable from each other as well as both are integrated in a unit. Thus, both can be attached and detached in a lump on the water heater, the installing work can be simplified. Moreover, each cleaning can easily performed.

Figure 15:
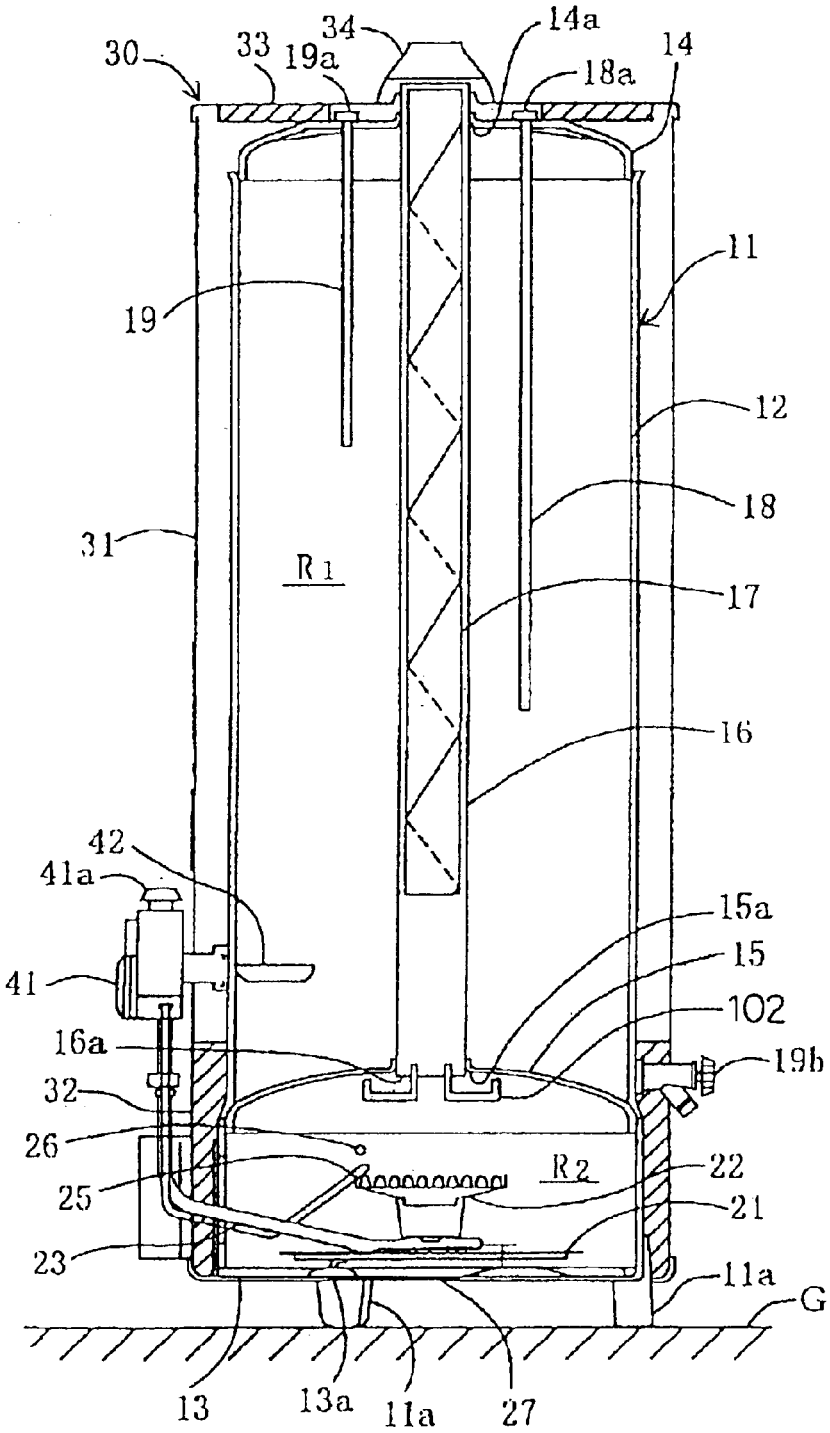
FIG. 15 is an elevational view in section schematically showing a water heater with a flame arrester, which is an embodiment of the third invention.

Next, an embodiment of the third invention in which the clogging of the flame arrester due to the combustion products and the like cannot be easily occurred will be described below with reference to FIG. 15. It should be noted that since the same reference numerals as the ones described above denote the same portions of the configurations, the description to be overlapped will be omitted.

Inside of the combustion chamber R2, a receiving member 102 which is falling prevention means in a flat annulus vessel shape is provided above the main burner 22 and located slightly lower from the lower end opening 16*a* which is the exhaust inlet of the exhaust pipe 16. The combustion products such as drain and the like are generated by gas components and water in the exhaust reacting with the wall of the exhaust pipe 16 and the inside wall of the combustion chamber R2, however, these combustion products tend to be especially generated mainly on the inside surface of the exhaust pipe 16, and the receiving member 102 receives and stores these combustion products.

Hence, while the heating within the hot water storage chamber R1 by the combustion of the main burner 22 is repeated, the combustion products such as drain and the like are generated by gas components and water in the exhaust reacting with the wall of the exhaust pipe 16 and the inside wall of the combustion chamber R2, these combustion products are peeled off the wall surface and fall, these are efficiently received by the receiving member 102 provided beneath the exhaust pipe 16, the falling can be prevented, thereby being capable of preventing the clogging of the flame arrester 27 due to the combustion products. As a result, the chore of cleaning the clogging of the flame arrester 27 due to the combustion products can be deleted.

Next, a modified example of the receiving member will be described below.

Figure 16:
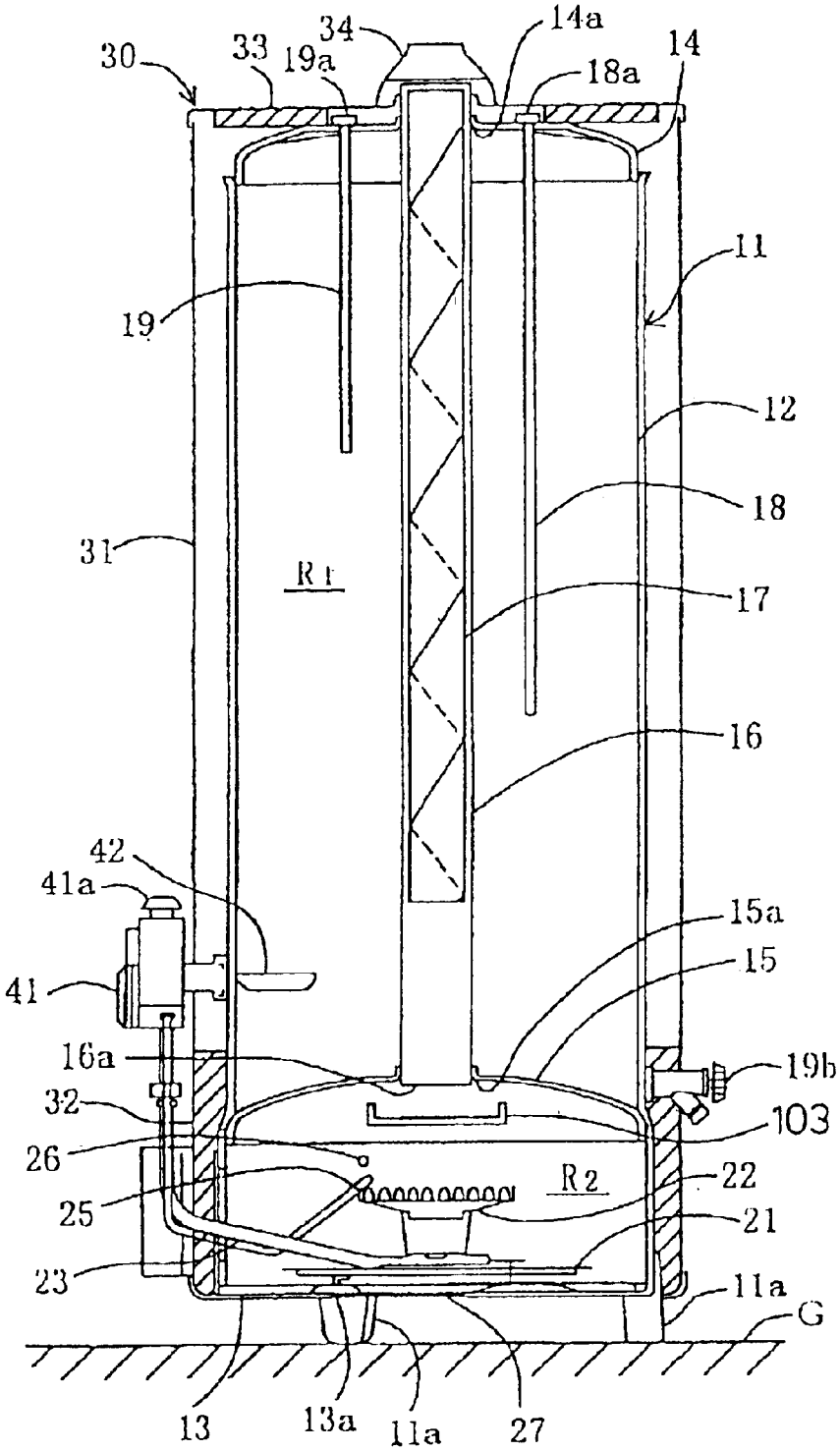
FIG. 16 is an elevational view in section schematically showing a water heater with a flame arrester, which is the modified example 1.
Figure 17:
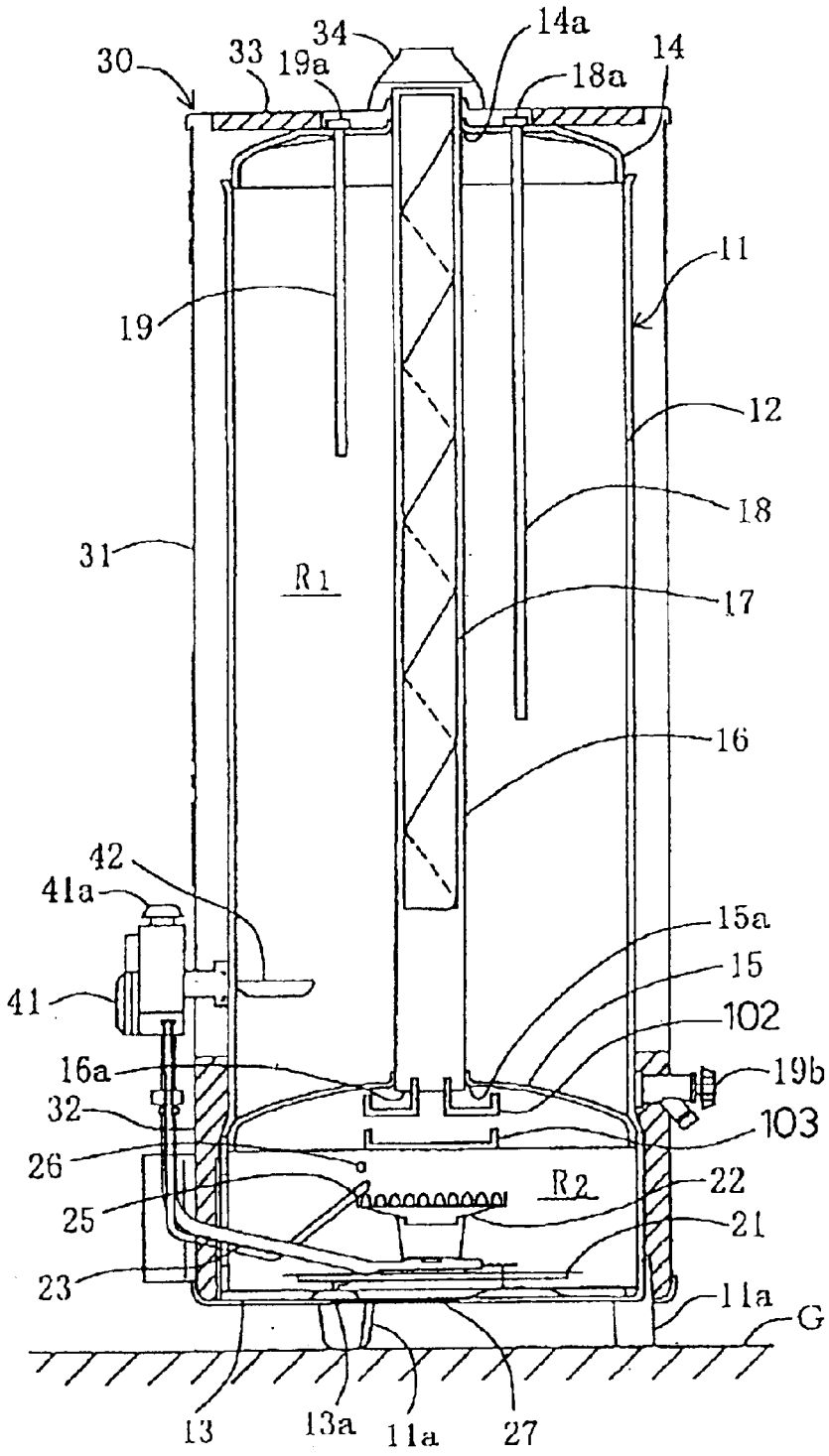
FIG. 17 is an elevational view in section schematically showing a water heater with a flame arrester, which is the modified example 2.

As for the modified example 1, as a receiving member for preventing the falling as shown in FIG. 16, the receiving member 103 which is fall prevention means in a circular and flat vessel shape without a hole is provided above the main burner 22 and located slightly beneath the lower end opening 16*a* of the exhaust inlet of the exhaust pipe 16 in the combustion chamber R2. Thus, the combustion products which are peeled off the wall surface of the exhaust pipe 16 and fall are efficiently received by the receiving member 103, and the falling can be prevented. Therefore, the clogging of the flame arrester 27 provided on the bottom plate 13 due to the combustion products can be hindered and prevented and the chore of cleaning the flame arrester can be deleted. Moreover, as for the modified example 2, as shown in FIG. 17, the above-described receiving member 103 can be also arranged beneath the above-described receiving member 102.

Figure 18:
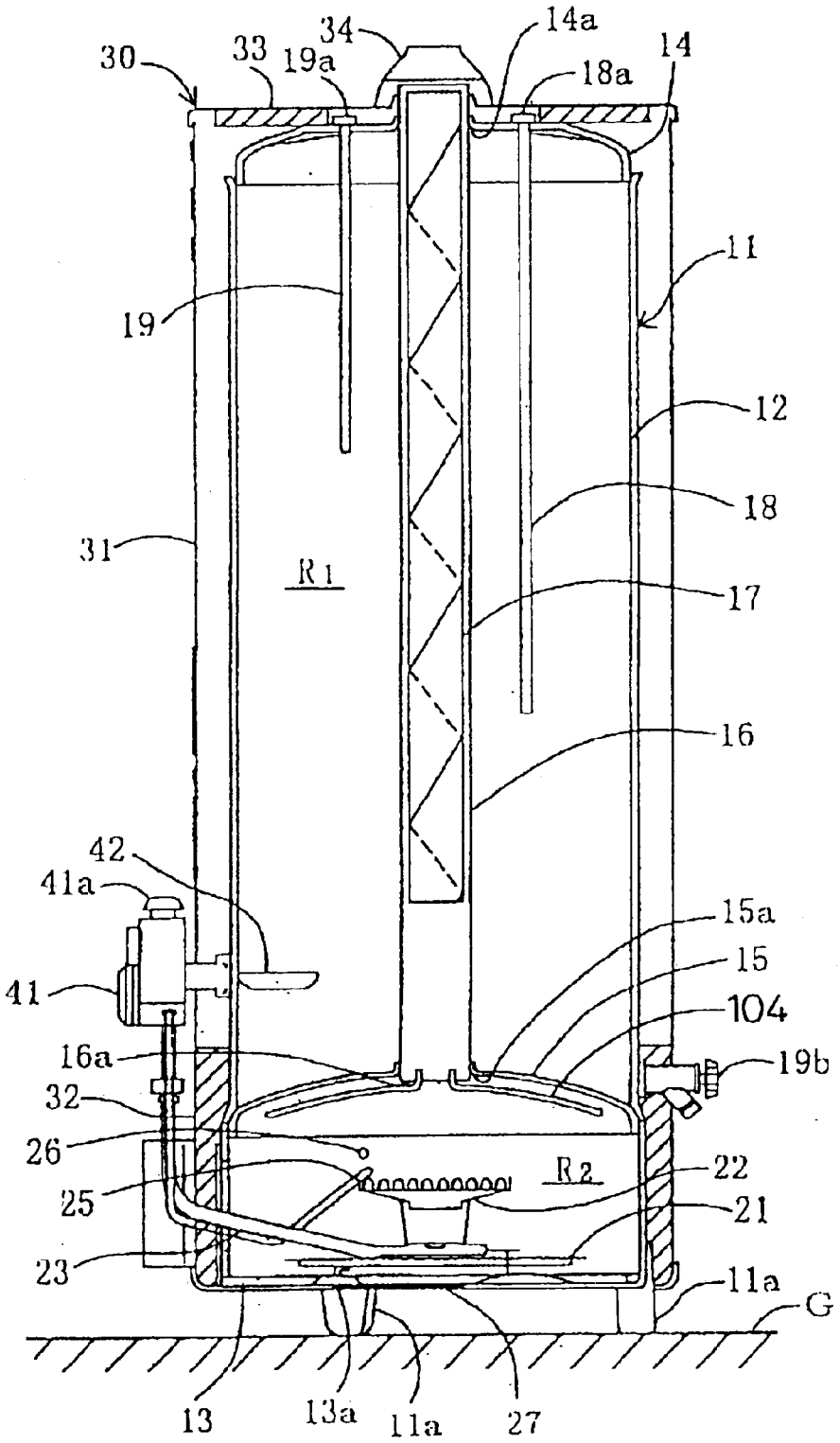
FIG. 18 is an elevational view in section schematically showing a water heater with a flame arrester, which is the modified example 3.
Figure 19:
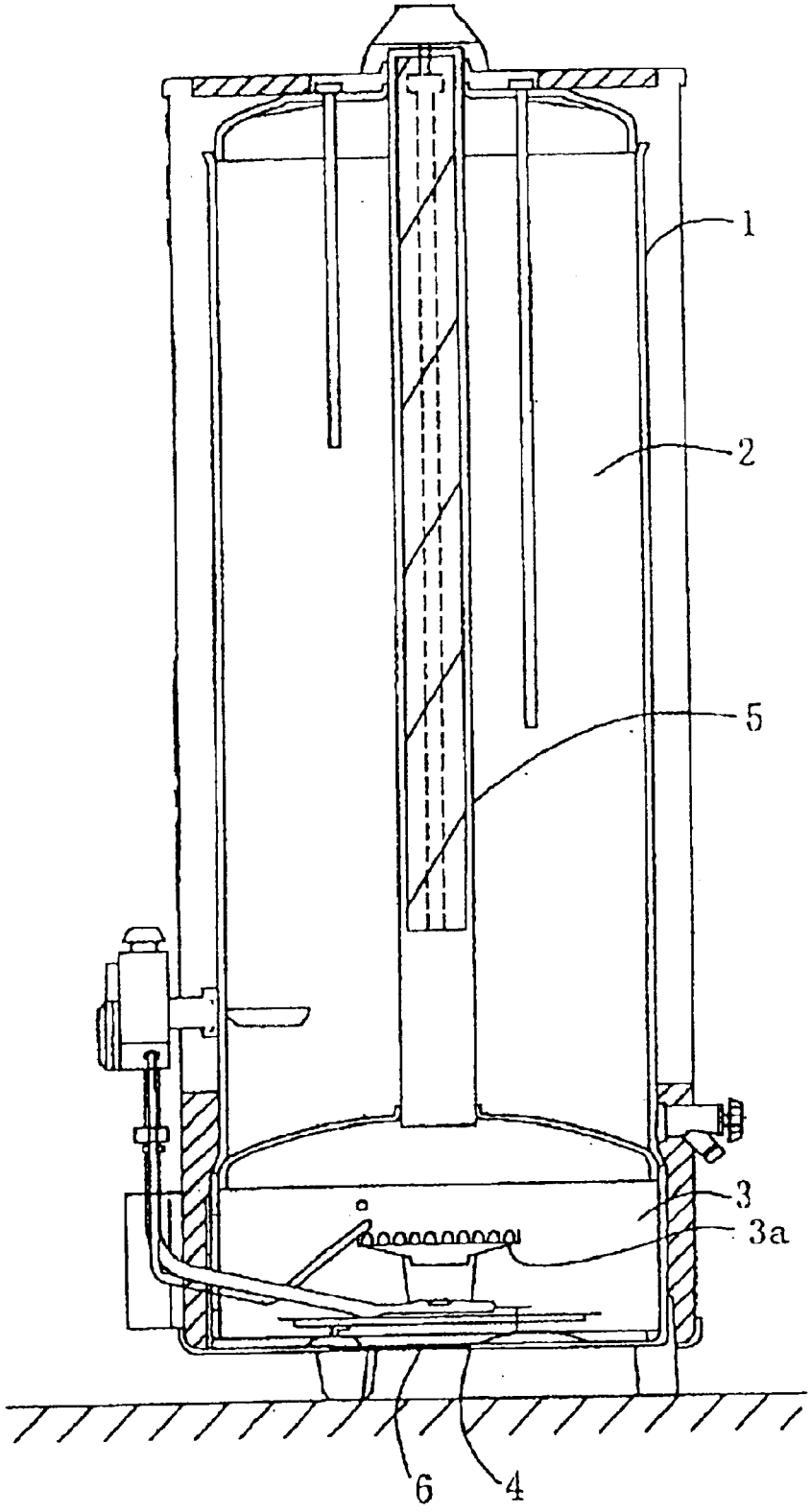
FIG. 19 is an elevational view in section schematically showing a water heater with a flame arrester, which is a prior art.

Next, as for the modified example 3, an annulus receiving member 104 for preventing the falling, as shown in FIG. 18, whose curvature extends from the slightly inside of the lower end opening 16*a* of the exhaust inlet of the exhaust pipe 16 to nearby the circumference of the lower end plate 15 along its curvature surface in a diameter direction is provided above the main burner 22 and located slightly lower from the opening 16*a* in the combustion chamber R2. Specifically, the flame arrester 27 provided on the bottom plate portion 13 is almost entirely covered with the receiving member 104. Thus, the combustion products which are peeled off the wall surface of the exhaust pipe 16 and fall are received by the receiving member 104, and the falling on the flame arrester 27 can be prevented. Therefore, the clogging of the flame arrester 27 due to the combustion products can be prevented and the chore of cleaning the combustion products can be deleted.

The occurrence of carbon monoxide poisoning in the room outside of the body can be prevented by the safety apparatus, and the safety within the room can be guaranteed.

Moreover, the safety within the room can be securely maintained by shutting off the fuel supply to the burner or by warning the abnormality according to the abnormal detection result of the flame of burner or the clogging abnormal detection result of the flame arrester.

Furthermore, the safety within the room can be securely maintained by shutting off the fuel supply to the burner or by warning the abnormality according to the clogging state detection result of the flame arrester.

Since the purified air removed larger dust from the air outside by the dust collection filter can be sent to the flame arrester, the clogging of the flame arrester can be largely delayed comparing to the prior art and the chore of cleaning the flame arrester can be reduced and the trouble occurred with the shortage of the air supply due to the clogging of the flame arrester can be prevented as well.

Moreover, The clogging of the dust collect on filter can be delayed by providing the dust collection filter beneath the burner in a horizontal direction and making the accumulated dust fall by its weight, and the chore of cleaning them can be reduced.

Moreover, the clogging factors from the inside and outside of the combustion chamber to the flame arrester by arranging the flame arrester and dust collection filter vertically on the side wall of the combustion chamber can be diminished, as a result, the chore of cleaning the flame arrester can be largely reduced.

Moreover, [according to the invention of claim 9,] the dust collection filter and the flame arrester can be easily handled by integrally configuring the flame arrester and the dust collection filter and making both attachable and detachable from each other.

Moreover, the flame arrester cannot be easily clogged and the chore of cleaning the flame arrester can be largely reduced by substantially providing two dust collection filters in order to remove larger dust further securely. Furthermore, the dust clogged can be efficiently cleaned by at least the dust collection filter on the upstream side tending to accumulate the dust easily being detachable.

Moreover, the dust collection filter cannot be easily clogged and the chore of cleaning the filter can be reduced by maintaining the dust collection filter at a high temperature using the heating means for automatically removing larger dust clogged in the dust collection filter.

Moreover, the clogging of the flame arrester due to the combustion products can be prevented, the chore of cleaning the flame arrester can be deleted and the trouble occurred with the air supply shortage due to the clogging of the flame arrester.

Moreover, the falling of the combustion products from the exhaust inlet where the combustion products mainly generates can be efficiently received and the clogging of the flame arrester can be efficiently prevented by providing a receiving member in an annulus shape or in a circular shape without a hall beneath the exhaust inlet.

Moreover, the fall of the combustion products to the flame arrester can be prevented and the chore of cleaning the flame arrester can be deleted by providing a receiving member which covers most of the upper portion of the flame arrester.

It will also be appreciated that, although a limited number embodiments of the inventions have been described in detail for purposes of illustration, various modifications may be made without departing from the spirit and scope of the inventions. Accordingly, the inventions should not be limited except as by the appended claims.

DESCRIPTION OF REFERENCE NUMERALS

10 . . . WATER HEATER WITH FLAME ARRESTER
11 . . . BODY
15 . . . LOWER END PLATE
16 . . . EXAUST PIPE
22 . . . MAIN BURNER
23 . . . GAS SUPPLY PIPE
25 . . . PILOT BURNER
26 . . . THERMOCOUPLE
27 . . . FLAME ARRESTER
30 . . . OUTER CASE
41 . . . CONTROLLER
44 . . . ALARM
50 . . . PILOT BURNER
56 . . . WIRE GAUZE
60 . . . SENSOR BURNER
61 . . . MIXTURE PIPE
64 . . . THERMOCOUPLE
67 . . . PILOT BURNER
70 . . . GAS SHUT OFF VALVE
92 . . . DUST COLLETION FILTER
102 . . . RECEIVING MEMBER
R1 . . . HOT WATER STORAGE CHAMBER
R2 . . . COMBUSTION CHAMBER

What is claimed is:

1. A water heater with a flame arrester comprising:

a combustion chamber formed approximately airtight, exhausting combustion gas by combustion at a burner provided in the combustion chamber from an exhaust inlet, and introducing air outside from an air supply inlet;

a flame arrester within said air supply inlet or an air supply passage for introducing air outside to the air supply inlet;

a dust collection filter is provided on the upstream side of the said flame arrester; and said flame arrester and said dust collection filter being arranged vertically on a side wall of the said combustion chamber.

2. The water heater with the flame arrester of claim 1 wherein the flame arrester and the dust collection filter are made attachable and detachable from each other.

3. The water heater with the flame arrester of claim 1 wherein the flame arrester and the dust collection filter are made integrally configured.

4. The water heater with the flame arrester of claim 1 wherein the dust collection filter comprises a first filter and a second filter arranged so that respective openings of said first filter and said second filter are not projectively overlapped as well as said first filter and said second filter being configured opposing each other, and at least the dust collection filter on the upstream side is made attachable and detachable.

5. The water heater with the flame arrester of claim 1 further comprises a heating means for maintaining the dust collecting filter at a high temperature.

6. A water heater with a flame resister comprising:

a combustion chamber formed approximately airtight, exhausting combustion gas by combustion at a burner provided in the combustion chamber from an exhaust inlet, and introducing air outside from an air supply inlet;

a flame arrester within said air supply inlet or an air supply passage for introducing air outside to the air supply inlet;

a dust collection filter provided on the upstream side of the said flame arrester; and the dust collection filter comprises a first filter and a second filter arranged so that respective openings of said first filter and said second filter are not projectively overlapped as well as said first filter and said second filter being configured opposing each other, and at least the dust collection filter on the upstream side is made attachable and detachable.

* * * * *